US006183303B1

(12) United States Patent
Sato

(10) Patent No.: US 6,183,303 B1
(45) **Date of Patent: *Feb. 6, 2001**

(54) SHIELDED CABLE END-PROCESSING CONSTRUCTION

(75) Inventor: Kei Sato, Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 09/311,755

(22) Filed: May 14, 1999

(30) Foreign Application Priority Data

May 20, 1998 (JP) ..... 10-138427

(51) Int. Cl.[7] ..... H01R 9/03
(52) U.S. Cl. ..... 439/610; 439/99; 439/585
(58) Field of Search ..... 439/99, 98, 610, 439/581, 394–578, 585, 92; 174/51

(56) References Cited

U.S. PATENT DOCUMENTS 4,195,895 * 4/1980 Ziegler ..... 439/99
4,427,248 * 1/1984 Smith ..... 439/98
5,931,698 * 8/1999 Kodama ..... 439/578

FOREIGN PATENT DOCUMENTS 5-15359 2/1993 (JP) ..... H01R/13/655
6-349532 12/1994 (JP) ..... H01R/9/05

* cited by examiner

*Primary Examiner*—Paula Bradley
*Assistant Examiner*—Ross Gushi
(74) *Attorney, Agent, or Firm*—Sughrue, Mion, Zinn, Macpeak & Seas, PLLC

(57) ABSTRACT

A shielded cable connector assembly in which a shielded cable includes an insulating layer formed on an outer peripheral surface of a conductor, and a sheath layer formed on an outer surface of the insulating layer through a braid, and a terminal is pressed to grip the conductor and the insulating layer of the shielded cable, thereby providing the terminal with the shielded cable. The terminal with the shielded cable is inserted into a terminal receiving chamber in a housing body. One side wall of the housing body is notched to form an operation opening at the terminal receiving chamber. A braid contact member projects into the terminal receiving chamber from the operation opening. The braid contact member has a size smaller than an outer diameter of the shielded cable. When the terminal with the shielded cable is inserted into the terminal receiving chamber, the braid contact member is automatically inserted between the sheath layer and the insulating layer. The braid contact member includes an L-shaped contact body, and a contact portion formed on and extending from a free end of the contact body in a direction opposite to a terminal inserting direction, the contact portion being formed into a sharp edge.

12 Claims, 11 Drawing Sheets

SHIELDED CABLE END-PROCESSING CONSTRUCTION

BACKGROUND OF THE INVENTION

1. Field of the Invention

This invention relates to a construction of processing an end portion of a shielded cable.

2. Description of the Related Art

As shown in FIG. 14, a shielded cable 60 comprises a conductor 61, an insulating layer 62 formed on an outer peripheral surface of the conductor 61, and a sheath layer 64 formed on an outer surface of the insulating layer 62 through a braid 63. There has heretofore been proposed a connecting member 65 (see FIG. 15) to which the conductor 61 and the insulating layer 62 of the shielded cable 60 are adapted to be connected (Japanese Utility Model Unexamined Publication No. Hei. 5-15359).

The connecting member 65 includes an inner tubular connecting portion 66, and an outer tubular connecting portion 67 provided in surrounding relation to the inner connecting portion 66, the two connecting portions 66 and 67 being integrally connected together. The connecting member 65 is press-fitted on an end portion of a shielded cable 60', at which the insulating layer 62 is exposed, as shown in FIG. 16(*a*), and the braid 63 and the sheath layer 62 are held between the inner and outer connecting portions 66 and 67 as shown in FIG. 16(*b*), so that the shielded cable 60' and the connecting member 65 are connected together. Thereafter, the connecting member 65 is inserted into a connector housing (not shown), so that the braid 63 is connected to a contact (not shown) within the connector housing.

FIGS. 17(*a*) and 17(*b*) show another conventional construction using a sheath layer holder member 68 and a shield tube 69 (Japanese Patent Unexamined Publication No. Hei. 6-349532).

As shown in FIG. 17(*a*), the sheath layer holder member 68, made of an elastic, insulating material, is press-fitted on an end portion of a shielded cable 60" at which a braid 63 is exposed. A smaller-diameter portion 68*a* of the sheath layer holder member 68 is held in intimate contact with an insulating layer 62, with the braid 63 turned over. At this time, part or the whole of the braid 63 is received in a larger-diameter portion 68*b* of the sheath layer holder member 68.

In this condition, as shown in FIG. 17(*b*), the shield tube 69, made of metal, is applied to cover the sheath layer holder member 68, and also the shield tube 69 is held in contact with the braid 63. Then, the shielded cable 60" is inserted into a connector housing (not shown), and the shield tube is connected to a contact (not shown) provided in the connector housing. Reference numeral 68*c* designates a through-hole in the sheath layer holder member 68.

However, the efficiency of insertion of the shielded cable 60' into the connecting member 65, as well as the efficiency of insertion of the shielded cable 60" into the sheath layer holder member 68 and the shield tube 69, is very poor. Besides, there is a fear that the size of the outer connecting portion 67 increases with the increase of the sheath layer 64 of the shielded cable 60'. There has been encountered a further drawback that since the sheath layer holder member 68 and the shield tube 69 must be mounted on the shielded cable 60", the twofold time and labor have been required.

SUMMARY OF THE INVENTION

With the above problems in view, it is an object of this invention to provide a shielded cable end-processing construction in which the efficiency of a shielded cable end-processing operation is enhanced.

In order to achieve the above object, according to the invention, there is provided a shielded cable end-processing construction wherein a shielded cable includes an insulating layer formed on an outer peripheral surface of a conductor and a sheath layer formed on an outer surface of the insulating layer through a braid, a terminal is pressed to grip the conductor and the insulating layer of the shielded cable, thereby providing the terminal with the shielded cable, and the terminal with the shielded cable is inserted into a terminal receiving chamber in a housing body, and wherein one side wall of the housing body is notched to form an operation opening at the terminal receiving chamber, a braid contact member projects into the terminal receiving chamber from the operation opening, a size of the braid contact member being smaller than an outer diameter of the shielded cable, and when the terminal with the shielded cable is inserted into the terminal receiving chamber, the braid contact member is automatically inserted between the sheath layer and the insulating layer.

BRIEF DESCRIPTION OF THE DRAWINGS

FIG. 16(*b*) is a view showing a condition in which the shielded cable is inserted into the connecting member;

FIG. 17(*b*) is a view showing a condition in which a shield tube is fitted on the shielded cable.

DETAILED DESCRIPTION OF THE PREFERRED EMBODIMENTS

Preferred embodiments of the present invention will now be described with reference to the drawings.

FIGS. 1 to 6 show a first embodiment of a shielded cable end-processing construction of the present invention.

Figure 1:
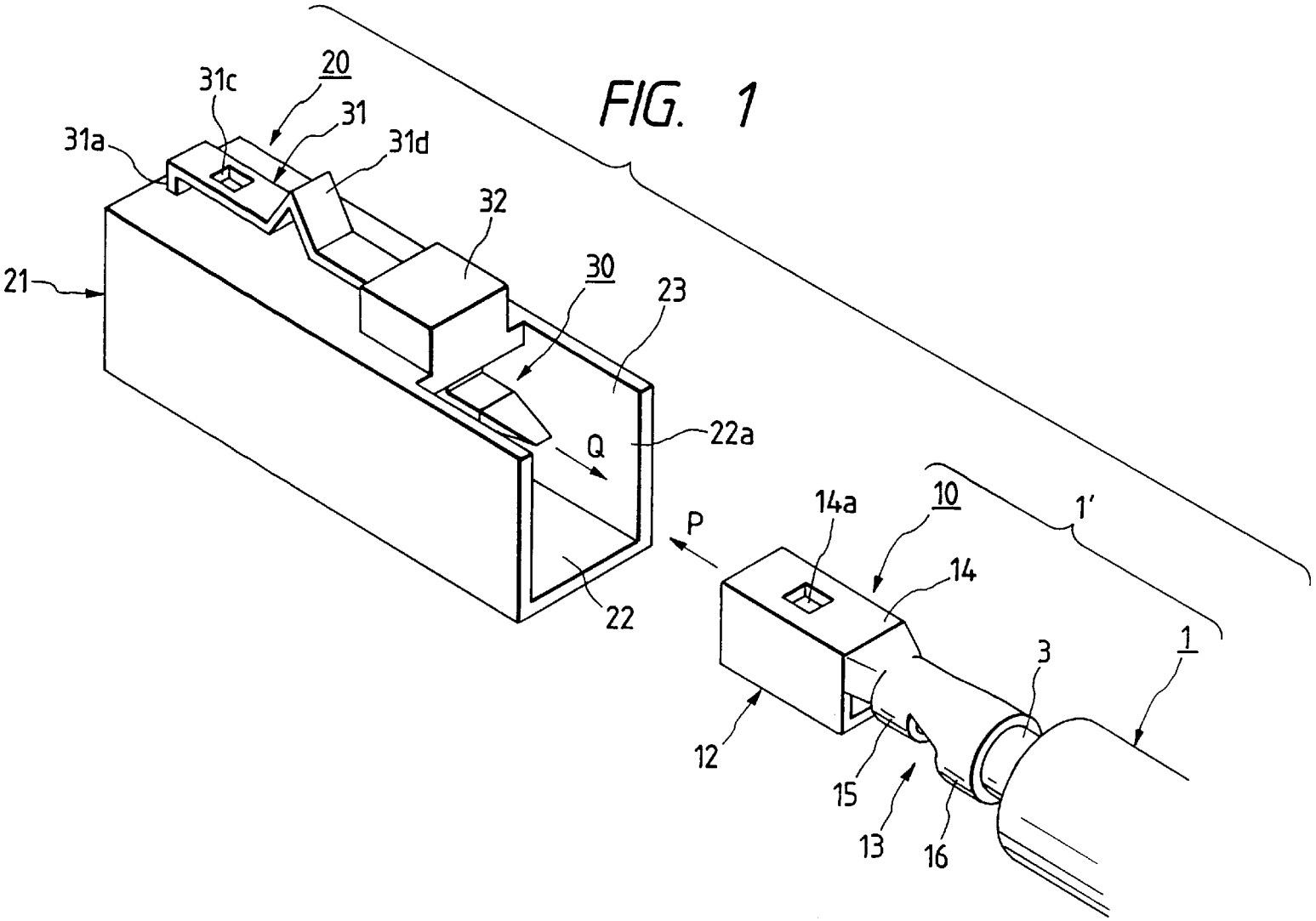
FIG. 1 is a perspective view of a first embodiment of a shielded cable end-processing construction of the present invention.
Figure 2:
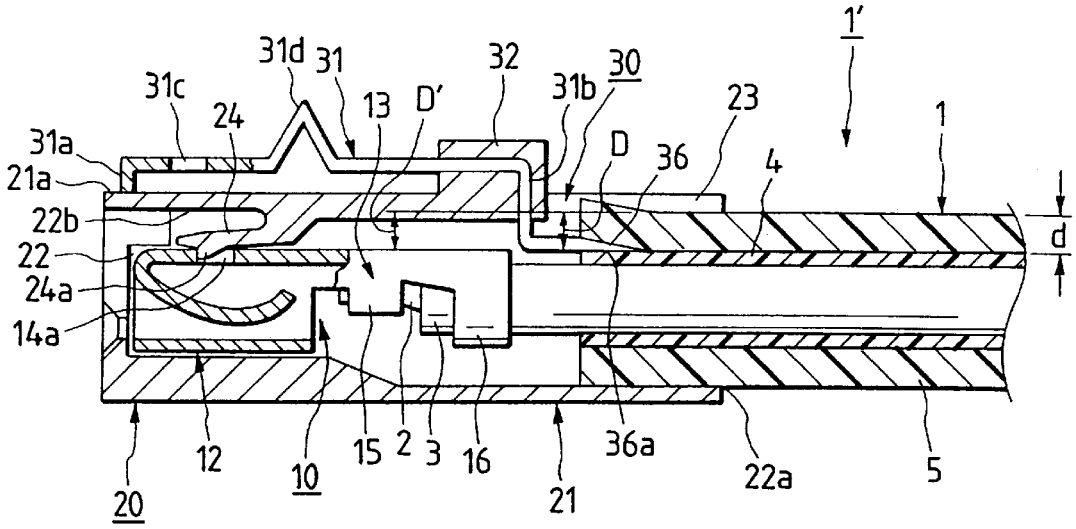
FIG. 2 is a cross-sectional view showing a condition in which a terminal with a shielded cable of FIG. 1 is inserted in a connector housing.

In FIGS. 1 and 2, in this shielded cable end-processing construction, a terminal 10, pressed to grip a conductor 2 and an insulating layer 3 of a shielded cable 1, is inserted into a terminal receiving chamber 22 in a connector housing 20, and at this time, a braid contact member 30, provided in the terminal receiving chamber 22, is automatically connected to a braid 4 of the shielded cable 1. The construction of the shielded cable 1 is the same as that of the conventional shielded cable, and therefore explanation thereof will be omitted.

The terminal 10 includes a terminal contact portion 12 of a box-like shape formed at one end thereof, and a shielded cable contact portion 13 formed at the other end thereof. An engagement hole 14*a* is formed through a bottom wall 14 of the terminal contact portion 12. The shielded cable contact portion 13 has a pair of conductor clamping piece portions 15 and 15 for gripping the conductor 2 of the shielded cable 1 and a pair of covering clamping piece portions 16 and 16 for gripping the insulating layer 3.

The connector housing 20 has the terminal receiving chamber 22 formed through a housing body 21, and an operation opening 23 is formed in that portion of an upper wall 21*a* of the housing body 21 disposed adjacent to an inlet 22*a* of the terminal receiving chamber 22. The braid contact member 30 extends into the terminal receiving chamber 22 through the operation opening 23. An elastic retaining piece portion 24 is formed on an inner surface of the terminal receiving chamber 22. A retaining projection 24*a* for engagement in the engagement hole 14*a* in the terminal 10 is formed at a free end of the elastic retaining piece portion 24.

One end 31*a* of a conductor plate 31 is fixedly secured to the upper wall 21*a* of the housing body 21, and the braid contact member 30 is formed integrally with and extends from the other end 31*b* of the conductor plate 31, and the other end 31*b* is supported by a holder block 32. The holder block 32 is fixedly secured to the upper wall 21*a* of the housing body 21. A lock hole 31*c* and a resilient mountain-like portion 31*d* are provided in the middle of the conductor plate 31.

Figure 3:
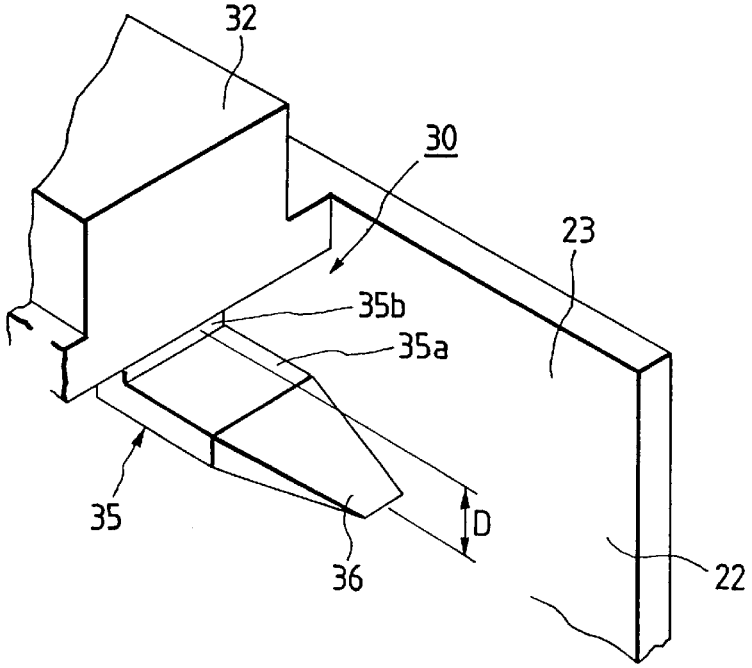
FIG. 3 is an enlarged, perspective view showing a braid contact member in FIG. 1.

As shown in FIGS. 1 and 3, the braid contact member 30 includes an L-shaped contact body 35, and a contact portion 36 formed on and extending from a distal end of a horizontal portion 35*a* of the contact body 35. A vertical portion 35*b* of the contact body 35 is connected to the other end 31*b* of the conductor plate 31. The contact portion 36 projects from the distal end of the horizontal portion 35*a* in a direction Q opposite to a terminal inserting direction P. The contact body 35 extends from a peripheral edge portion of the operation opening 23 into the terminal receiving chamber 22, and the contact portion 36 is disposed in the terminal receiving chamber 22.

As shown in FIG. 2, the distance D between an inner surface 22*b* of the terminal receiving chamber 22 and a lower surface 36*a* of the contact portion 36 is substantially equal to the thickness d of a sheath layer 5 of the shielded cable 1 (D=d), and is slightly smaller than the distance D' between the inner surface 22*b* of the terminal receiving chamber 22 and the bottom wall 14 of the terminal 10 (D≈D'). With this construction, when the terminal 1' with the shielded cable is to be inserted into the terminal receiving chamber 22, the contact portion 36 and the terminal 10 will not interfere with each other, and besides the time and labor, required for bringing the contact portion 36 into agreement with the boundary between the braid 4 and the sheath layer 5, is omitted. The contact portion 36 is formed into a sharp edge, and therefore when the terminal 1' with the shielded cable is inserted into the terminal receiving chamber 22, the contact portion 36 can be easily inserted between the braid 4 and the sheath layer 5.

A method of processing the end portion of the shielded cable 1 will now be described.

Figure 4:
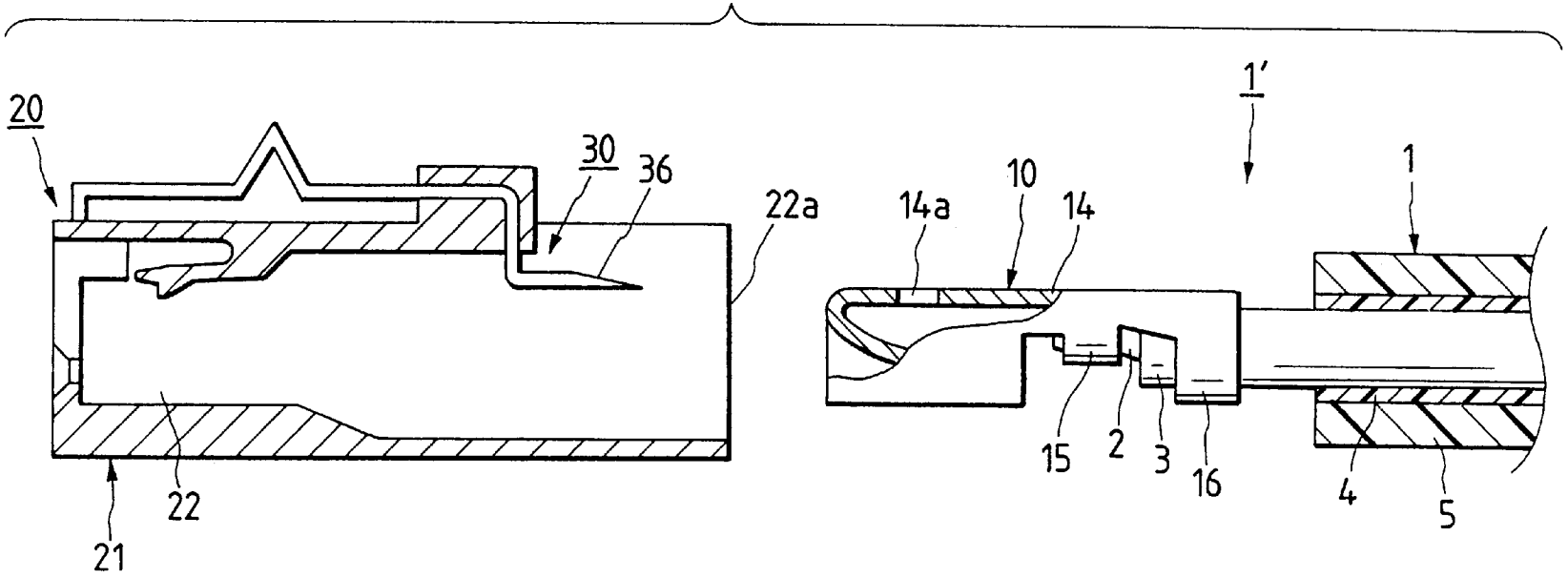
FIG. 4 is a cross-sectional view showing a condition before the terminal with the shielded cable of FIG. 1 is inserted into the connector housing.

As shown in FIG. 4, a desired length of the conductor 2 and a desired length of the insulating layer 3 are exposed respectively at the end portion of the shielded cable 1. The conductor clamping piece portions 15 of the terminal 10 are pressed to grip the conductor 2, and the covering clamping piece portions 16 are pressed to grip the insulating layer 3, thereby forming the terminal 1' with the shielded cable. The terminal 1' with the shielded cable is inserted into the terminal receiving chamber 22 of the housing body 21 through the inlet 22*a* thereof, with the bottom wall 14 of the terminal 10 directed upwardly.

Figure 5:
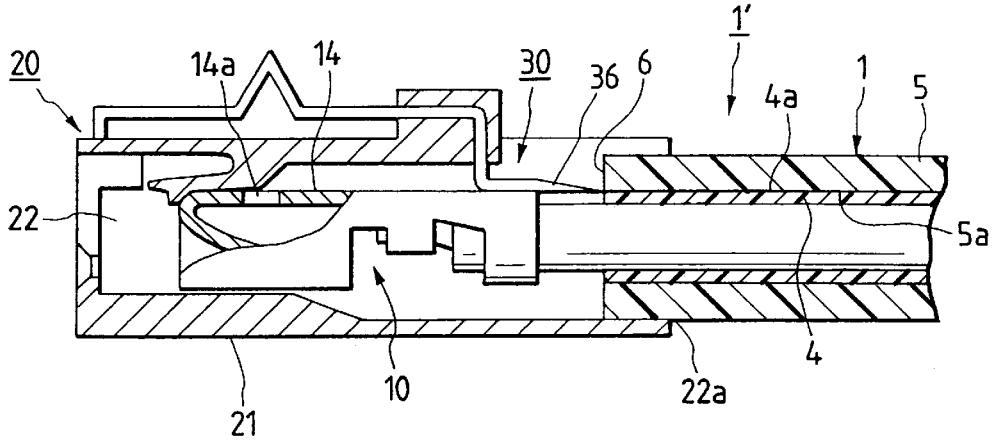
FIG. 5 is a cross-sectional view showing a condition in which a contact portion is abutted against the shielded cable.
Figure 6:
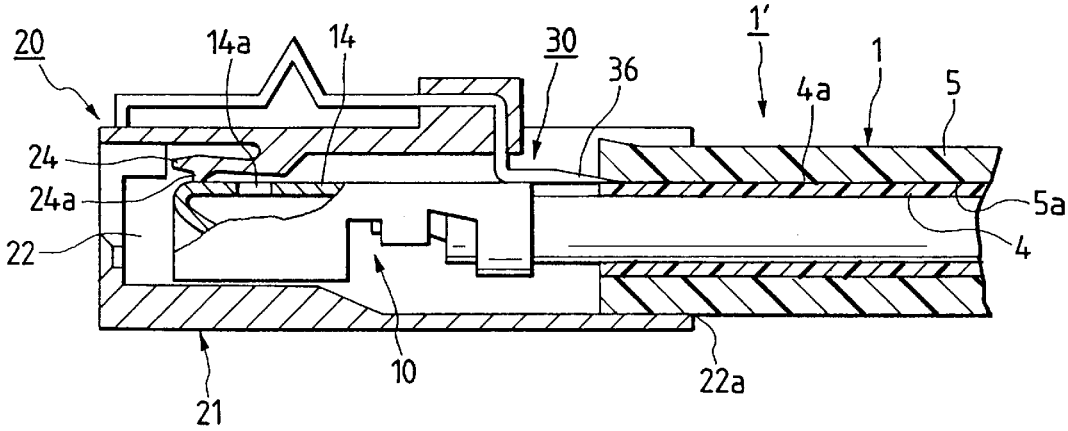
FIG. 6 is a cross-sectional view showing a condition in which the contact portion of FIG. 5 pierces between a braid and a sheath layer.

During this inserting operation, the contact portion 36 of the braid contact member 30 will not contact the bottom wall 14, and abuts against that portion of an end surface 6 defining the boundary between the braid 4 and the sheath layer 5 as shown in FIG. 5. When the terminal 1' with the shielded cable is further pushed into the terminal receiving chamber 22, the contact portion 36 of the braid contact member 30 pierces into the area of contact between an outer surface 4*a* of the braid 4 and an inner surface 5*a* of the sheath layer 5 as shown in FIG. 6, and gradually advances.

The distal end of the contact portion 36 is formed into a sharp edge, and therefore the contact portion 36 can easily pierce into the end surface 6 between the braid 4 and the sheath layer 5. The contact portion 36 is inserted between the braid 4 and the sheath layer 5 until the retaining projection 24*a* of the elastic retaining piece portion 24 becomes engaged in the engagement hole 14*a* in the terminal 10. Therefore, merely by inserting the terminal 1' with the shielded cable into the terminal receiving chamber 22, the contact portion 36 can be easily brought into contact with the braid 4 of the shielded cable 1 (see FIG. 2).

Figure 7:
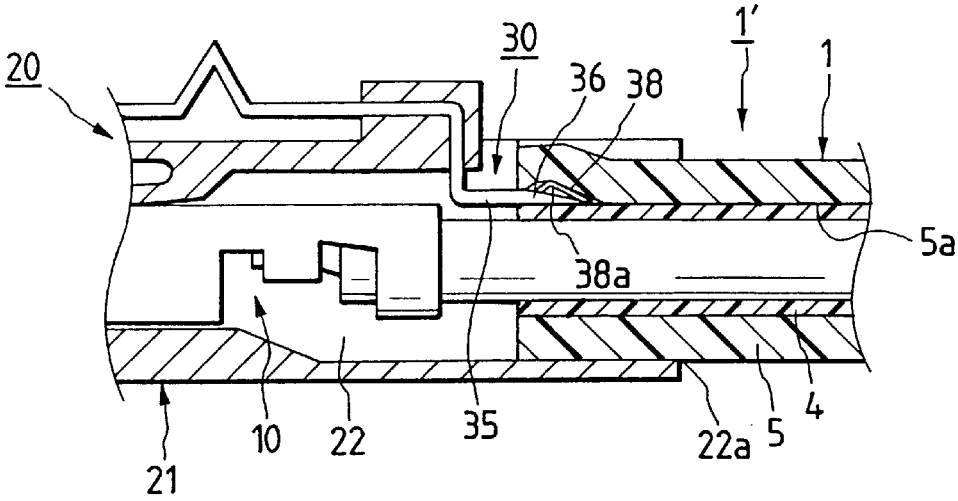
FIG. 7 is a cross-sectional view of a second embodiment of the shielded cable end-processing construction of the invention.
Figure 8:
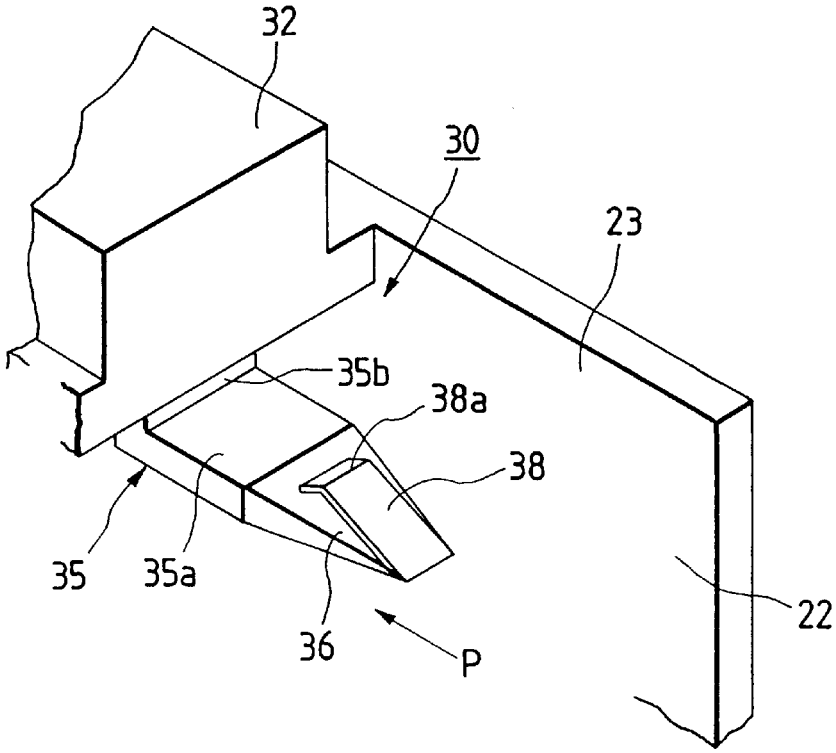
FIG. 8 is an enlarged, perspective view showing a braid contact member in FIG. 7.

FIGS. 7 and 8 show a second embodiment of the shielded cable end-processing construction of the present invention. The constituent parts identical to those of the first embodiment will be designated by identical names and reference numerals, respectively, and detailed description thereof will be omitted.

In this shielded cable end-processing construction shown in FIGS. 7 and 8, a resilient contact piece 38 is formed on the contact portion 36 of the braid contact member 30 of the first embodiment.

The resilient contact piece 38 extends from the vicinity of the distal end of the contact portion 36 in a terminal inserting direction P. The thickness of the resilient contact piece 38 is substantially the same as that of the contact portion 36. A retaining mountain-like portion 38*a* is formed at a free end portion of the resilient contact piece 38. When the terminal 1' with the shielded cable is inserted into the terminal receiving chamber 22, the retaining mountain-like portion 38*a* slidingly moves relative to the inner surface 5*a* of the sheath layer 5, and then is caught by the inner surface 5*a*.

At the same time, the retaining mountain-like portion 38*a* is spring-biased against the inner surface 5*a* of the sheath layer 5. As a result, the retention force of the contact portion 36 in the shielded cable 1 is increased. Therefore, the rearward withdrawal of the contact portion 36 from the shielded cable 1 is prevented, and also the connection between the braid 4 and the contact portion 36 can be effected more positively.

Figure 9:
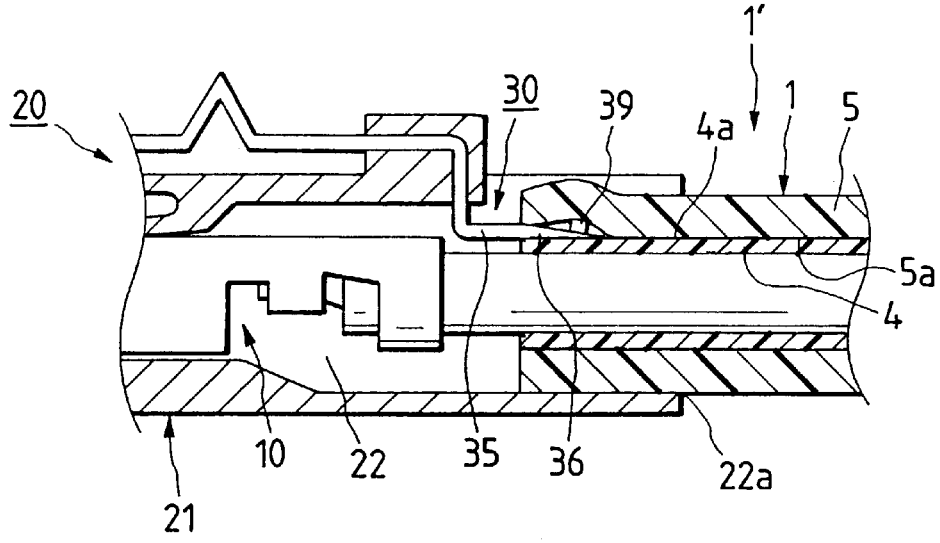
FIG. 9 is a cross-sectional view of a third embodiment of the shielded cable end-processing construction of the invention.
Figure 10:
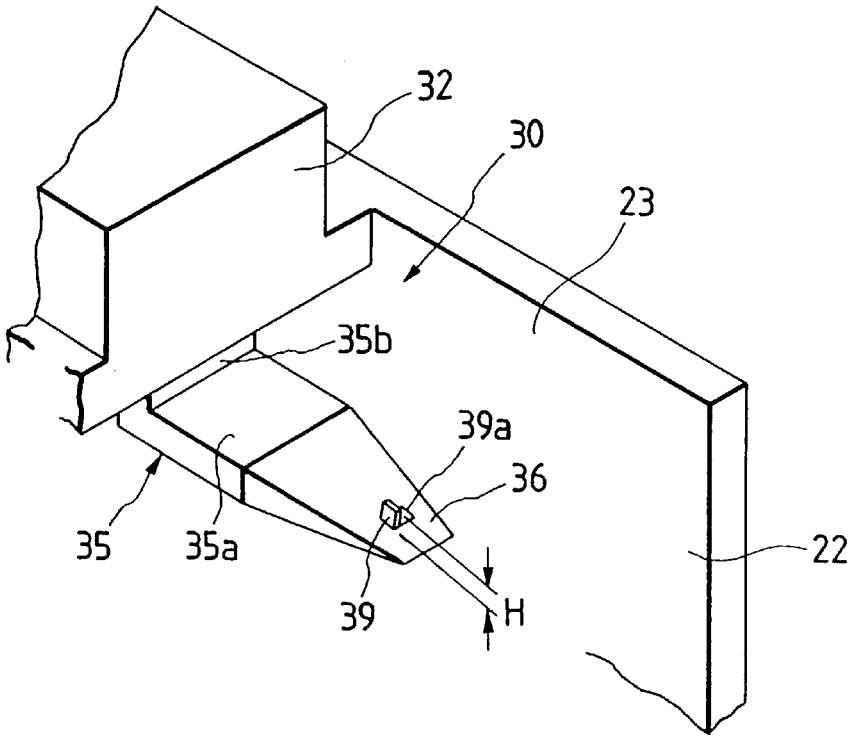
FIG. 10 is an enlarged, perspective view of a braid contact member in FIG. 9.

FIGS. 9 and 10 show a third embodiment of the shielded cable end-processing construction of the present invention. The constituent parts identical to those of the first embodiment will be designated by identical names and reference numerals, respectively, and detailed description thereof will be omitted.

In this shielded cable end-processing construction shown in FIGS. 9 and 10, a vertical contact piece 39 is formed on the contact body 35 of the braid contact member 30 of the first embodiment.

The vertical contact piece 39 is formed at the horizontal portion 35*a* of the contact body 35 by stamping, and is disposed substantially centrally of the width of this horizontal portion 35*a*. The vertical contact piece 39 is disposed perpendicularly to the contact portion 36. That side of the vertical contact piece 39, disposed close to the contact portion 36, is formed into a slanting surface 39*a* so as to reduce the resistance offered when inserting the terminal. The length H of projecting of the vertical contact piece 39 is set smaller than the thickness d (see FIG. 2) of the sheath layer 5 (H<d).

Figure 11:
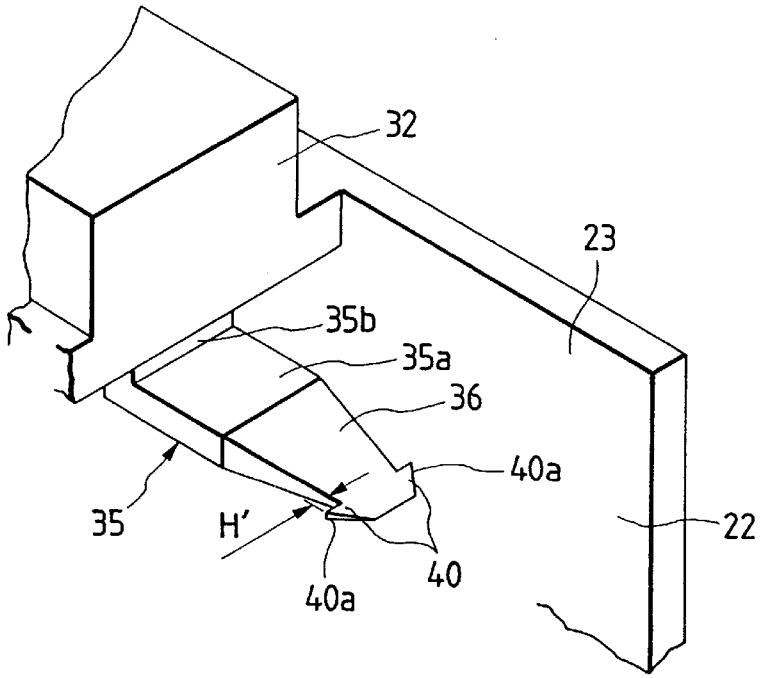
FIG. 11 is a perspective view showing a modified structure of FIG. 10.

FIG. 11 shows a modification of the vertical contact piece 39 in which horizontal contact pieces 40 are formed respectively at opposite side edges of the contact portion 36 in parallel relation to the contact body 35. Like the vertical contact piece 39, each of the two horizontal contact pieces 40 and 40 have a slanting surface 40*a*. Therefore, the contact portion 36 has a substantially arrowhead-shape as a whole. The length H' of projecting of each horizontal contact piece 40 from the contact portion 36 is so determined that the horizontal contact pieces 40 will not pierce the sheath layer 5 during and after the insertion of the terminal. The thickness of the vertical contact piece 39 and the thickness of the horizontal contact pieces 40 are substantially the same as that of the contact body 35 or the contact portion 36 (see FIGS. 9 and 11).

As shown in FIGS. 9 to 11, the vertical contact piece 39 (the horizontal contact pieces 40) is formed on the contact body 35 or the contact portion 36 of the braid contact member 30, and with this construction when the terminal 10 is inserted into the terminal receiving chamber 22, the vertical contact piece 39 (the horizontal contact pieces 40) is caused to bite into the sheath layer 5. Therefore, the rearward withdrawal of the contact portion 36 from the shielded cable 1 is prevented. Therefore, the braid contact member 30 and the braid 4 can be contacted with each other more positively.

Figure 13:
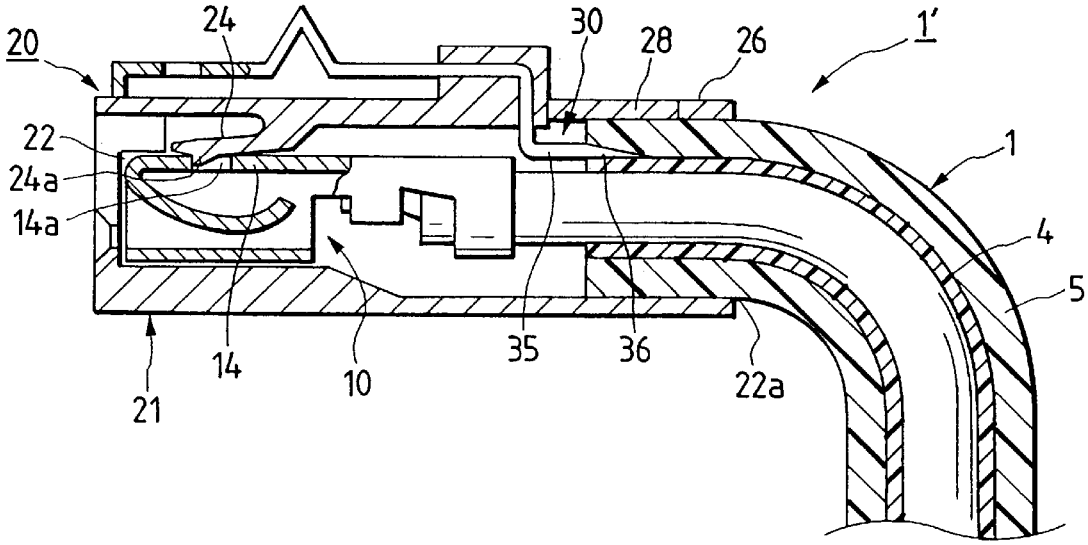
FIG. 13 is a cross-sectional view showing a condition in which a shielded cable, received in a connector housing of FIG. 12, is bent.
Figure 12:
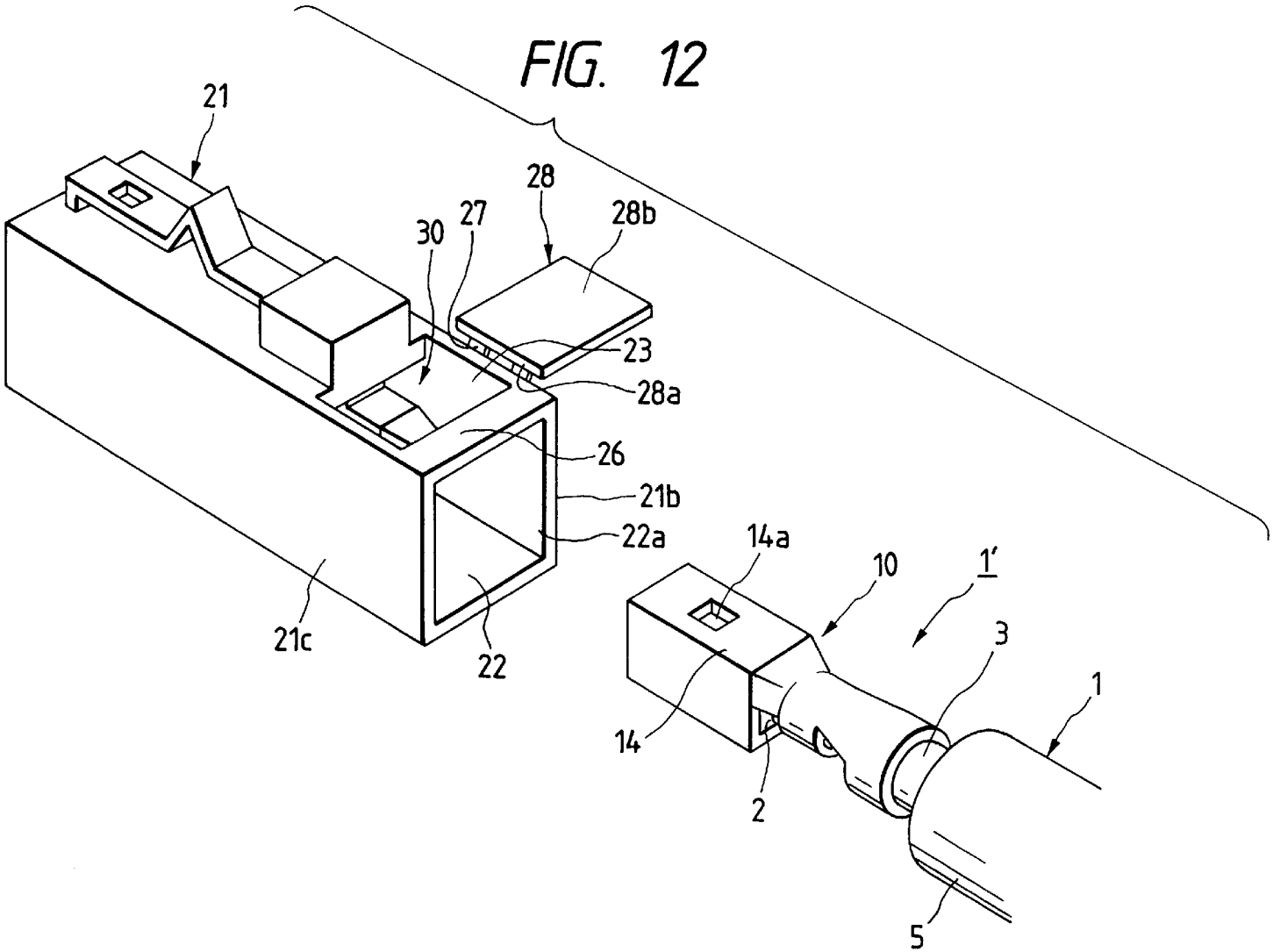
FIG. 12 is a perspective view of a fourth embodiment of the shielded cable end-processing construction of the invention.
Figure 14:
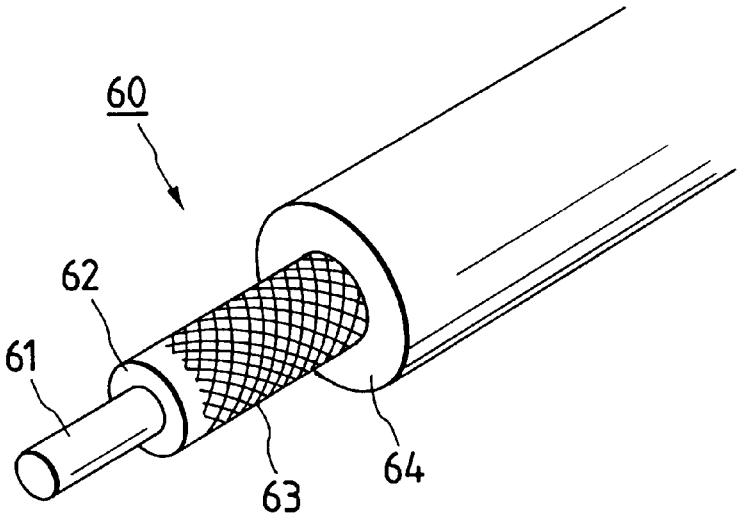
FIG. 14 is an enlarged, perspective view of a shielded cable.
Figure 15:
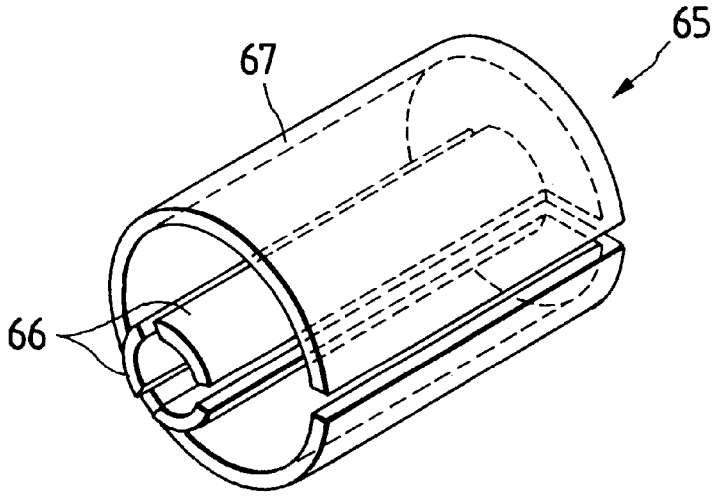
FIG. 15 PRIOR ART
FIG. 15 is an enlarged, perspective view of a conventional structure.
Figure 16A:
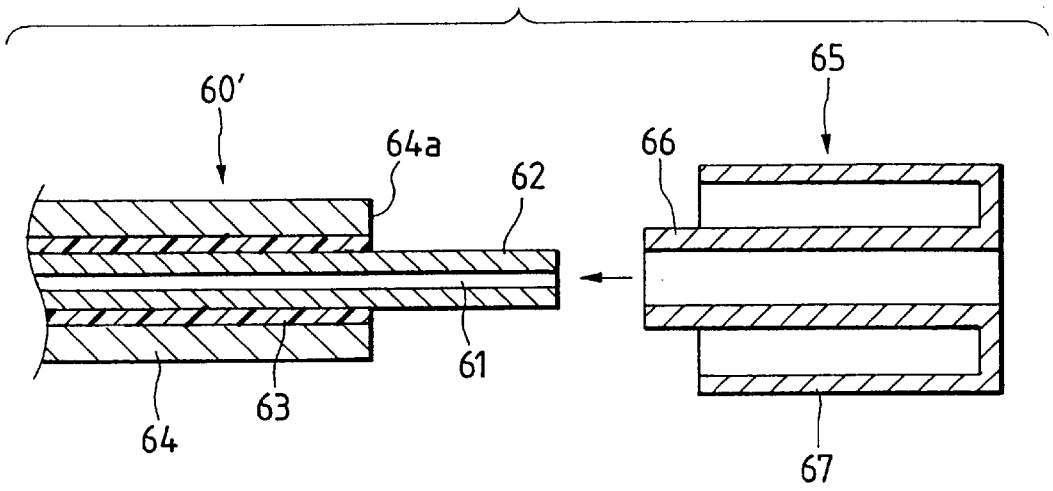
FIG. 16(a) PRIOR ART
FIG. 16(*a*) is a view showing a condition before the shielded cable is inserted into a connecting member of FIG. 15.
Figure 16B:
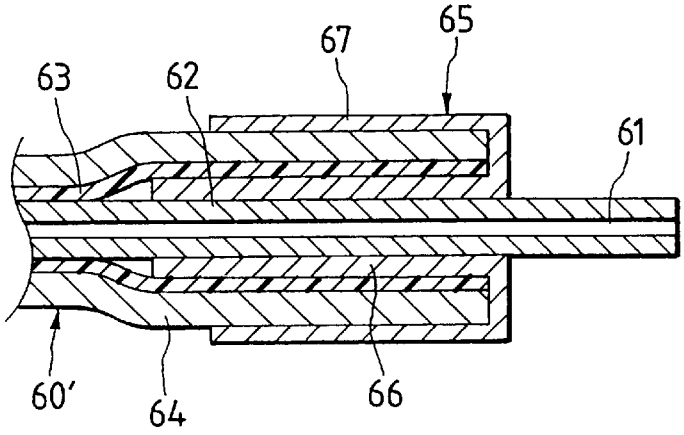
FIG. 16(b) PRIOR ART
Figure 17A:
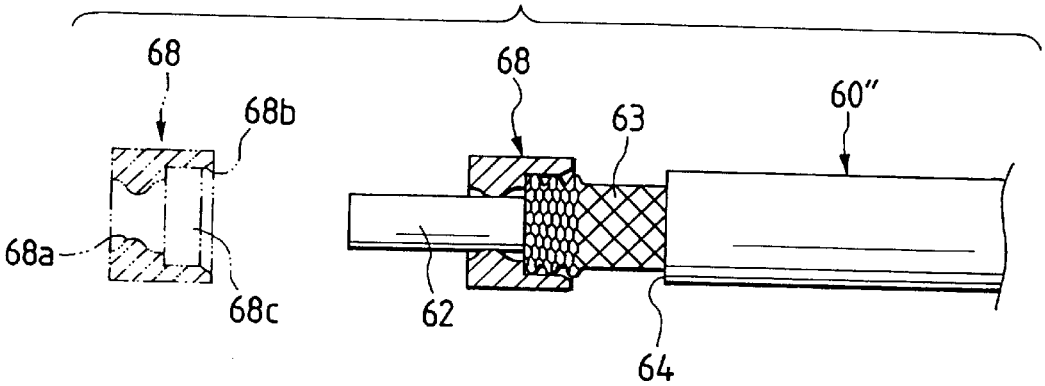
FIG. 17(a) PRIOR ART
FIG. 17(*a*) is a view of another conventional structure, showing a condition in which a sheath layer holder member is fitted on a shielded cable.
Figure 17B:
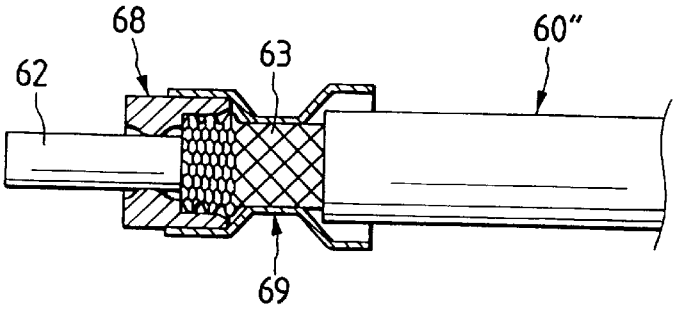
FIG. 17(b) PRIOR ART

FIGS. 12 and 13 show a fourth embodiment of the shielded cable end-processing construction of the present invention. The constituent parts identical to those of the first embodiment will be designated by identical names and reference numerals, respectively, and detailed description thereof will be omitted.

In this shielded cable end-processing construction shown in FIG. 12, a guide bar 26 for protecting the shielded cable 1 is provided at the operation opening 23 of the first embodiment, and a protection lid 28 is pivotally mounted on a right side wall 21*b* of a housing body 21 through hinges 27.

The guide bar 26 extends between the right and left side walls 21*b* and 21*c* of the housing body 21, and is disposed immediately adjacent to an inlet 22*a* of a terminal receiving chamber 22. One end 28*a* of the rectangular protection lid 28 is connected to the right side wall 21*b* of the housing body 21 through the hinges 27. Retaining means (not shown) are provided respectively at the other end 28*b* of the protection lid 28 and the left side wall 21*c* of the housing body 21.

As shown in FIGS. 12 and 13, when the terminal 1' with the shielded cable is inserted into the terminal receiving chamber 22, the retaining projection 24*a* of the elastic retaining piece portion 24 is engaged in the engagement hole 14*a* in the terminal 10, and also the guide bar 26 is held in intimate contact with the sheath layer 5 of the shielded cable 1, and therefore the terminal 1' with the shielded cable within the terminal receiving chamber 22 is held stably. Then, the protection lid 28 is moved to close the operation opening 23, so that the sheath layer 5 of the shielded cable 1 is pressed inwardly.

As a result, the terminal 1' with the shielded cable within the terminal receiving chamber 22 is held more stably. Since the terminal 1' with the shielded cable is more stably held within the terminal receiving chamber 22, the connection between the braid contact member 30 and the braid 4 is stable. Therefore, even if the shielded cable 1, connected to the terminal, is bent downwardly, the condition of contact between the braid contact member 30 and the braid 4 will not become unstable. The operation opening 23 is closed by the protective lid 28, and therefore the braid contact member 30 and the braid 4 are kept stably contacted with each other.

The braid contact members 30 of the first to fourth embodiments may have any suitable configuration in so far as the braid contact member 30 can be connected to the braid 4 simultaneously when the terminal 1' with the shielded cable is inserted into the terminal receiving chamber 22.

As described above, in the invention, the operation opening is formed in one side wall of the housing body, and the braid contact member, having a size smaller than the outer diameter of the shielded cable, projects into the terminal receiving chamber from the operation opening. Therefore, when the terminal with the shielded cable is inserted into the terminal receiving chamber, the braid contact member is inserted between the sheath layer and the insulating layer. Therefore, merely by inserting the terminal with the shielded cable into the terminal receiving chamber, the braid of the shielded cable can be easily connected to the braid contact member.

What is claimed is:

1. A shielded cable connector assembly for a shielded cable including an insulating layer formed on an outer peripheral surface of a conductor and a sheath layer formed on an outer surface of the insulating layer through a braid, said connector assembly comprising;

a terminal pressed to grip the conductor and the insulating layer of the shielded cable, thereby providing the terminal with the shielded cable; and a housing body including a terminal receiving chamber operative to receive the terminal with the shielded cable;

wherein one side wall of the housing body is notched to form an operation opening at the terminal receiving chamber, a braid contact member projects into the terminal receiving chamber from the operation opening, a size of the braid contact member being smaller than an outer diameter of the shielded cable, and when the terminal with the shielded cable is inserted into the terminal receiving chamber, the braid contact member is automatically inserted between the sheath layer and the insulating layer.

2. The shielded cable connector assembly according to claim 1, wherein a guide bar is provided at the operation opening, and extends in a direction intersecting the terminal inserting direction, and when the terminal with the shielded cable is inserted into the terminal receiving chamber, the guide bar is held in intimate contact with the sheath layer.

3. The shielded cable connector assembly according to claim 1, wherein a protection lid for covering the operation opening is pivotally mounted on the housing body.

4. The shielded cable connector assembly according to claim 1, wherein the braid contact member includes an L-shaped contact body, and a contact portion formed on and extending from a free end of the contact body in a direction opposite to a terminal inserting direction, the contact portion being formed into a sharp edge.

5. The shielded connector assembly according to claim 4, wherein a resilient contact piece is formed on the contact portion, and is turned back from the contact portion in the terminal inserting direction.

6. The shielded cable connector assembly according to claim 4, wherein a vertical contact piece operative to engage the sheath layer is formed on the contact body or the contact portion, and is disposed perpendicularly to the contact portion.

7. The shielded cable connector assembly according to claim 6, wherein the contact portion is substantially equal in thickness to the vertical contact piece.

8. The shielded cable connector assembly according to claim 4, wherein horizontal contact pieces operative to engage the sheath layer are formed on the contact body or the contact portion in parallel relation to the contact portion.

9. The shielded cable connector assembly according to claim 8, wherein the contact portion is substantially equal in thickness to the horizontal contact pieces.

10. An end-connector assembly used with a shielded cable having a conductor surrounded by an insulating layer, a braid and a sheath layer, said end-connector assembly comprising:

a terminal pressure fitted onto said conductor and said insulating layer, said terminal comprising;

a terminal contact portion having an engagement hole on a side thereof;

a conductor contact portion having a pair of conductor clamping portions operative to grip said conductor, and a pair of insulator clamping portions operative to grip said insulator, and a connector housing operative to receive said terminal, said connector housing comprising;

a terminal receiving chamber into which said terminal can be inserted;

a braid contact member attached to an inner wall of said connector housing at one end of said braid contact member and extending into said terminal receiving chamber at another end of said braid contact member, wherein said braid contact member is sloped from the end of said braid contact member attached to said inner wall down to a point at the end of said braid contact member extending into said terminal receiving chamber;

an elastic retention portion formed on an inner surface of said terminal receiving chamber and having a retaining projection operative to engage said terminal through said engagement hole.

11. An end-connector assembly in accordance with claim 10 wherein said braid contact portion is positioned such that the pointed end of said braid contact portion divides said braid and said sheath layer when said terminal is inserted into said terminal receiving chamber.

12. An end-connector assembly in accordance with claim 11 wherein said braid contact portion further comprises a resilient contact piece extending at an incline away from said pointed end and operative to engage said sheath layer.

* * * * *